United States Patent [19]

Llames

[11] Patent Number: 4,823,491

[45] Date of Patent: Apr. 25, 1989

[54] QUICK POINT REVERSIBLE SLING SWIVEL ASSEMBLY FOR A RIFLE OR THE LIKE FOR RIFLE AND SHOTGUNS

[76] Inventor: Emiliano C. Llames, 14 San Gregorio St., Capitol-8, Pasig, Metro Manila, Philippines, 3130

[21] Appl. No.: 120,845

[22] Filed: Nov. 16, 1987

[30] Foreign Application Priority Data

Nov. 21, 1986 [PH] Philippines ..... 9930

[51] Int. Cl.[4] ..... F41C 23/02

[52] U.S. Cl. ..... 42/85

[58] Field of Search ..... 42/85

[56] References Cited

U.S. PATENT DOCUMENTS

| | | | |
|---|---|---|---|
| 2,335,357 | 11/1943 | Pugsley et al. | 42/85 |
| 2,350,484 | 6/1944 | Williams | 42/85 |
| 2,480,662 | 8/1949 | McKinzie | 42/85 |
| 2,639,480 | 5/1953 | Magid | 42/85 |
| 2,642,689 | 6/1953 | Cline | 42/85 |
| 2,771,699 | 11/1956 | Herter | 42/85 |
| 2,885,812 | 5/1959 | Arpin | 42/85 |
| 3,066,375 | 12/1962 | Knowles et al. | 42/85 |
| 4,299,343 | 11/1981 | Atchisson | 42/85 |
| 4,571,872 | 2/1986 | Johnson | 42/85 |
| 4,665,641 | 5/1987 | Llames | 42/85 |

FOREIGN PATENT DOCUMENTS

| | | | |
|---|---|---|---|
| 5909 | 10/1985 | Philippines . | |
| WO85/00423 | 1/1985 | World Int. Prop. O. | 42/85 |

*Primary Examiner*—Charles T. Jordan

*Attorney, Agent, or Firm*—Watts, Hoffmann, Fisher & Heinke

[57] ABSTRACT

A sling swivel assembly for a rifle, shotgun, or similar firearm consists of a rear or butt swivel and a fore-end swivel, each including a receptacle part attached to the stock and a rotating part to which a sling is attached. A male extension on the rotating part is retained in the receptacle by a spring clip and can be released by deflecting the spring clip.

4 Claims, 3 Drawing Sheets

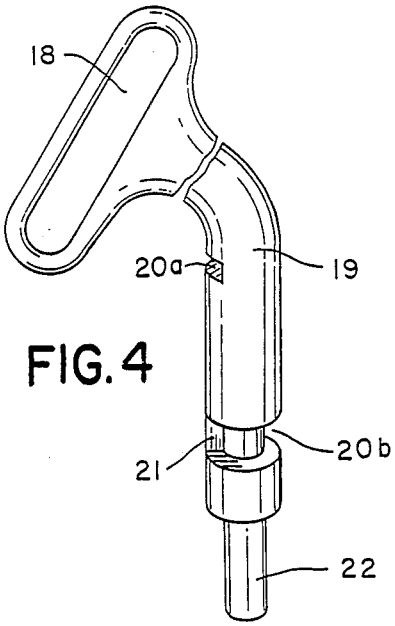
FIG. 4
FIG. 6
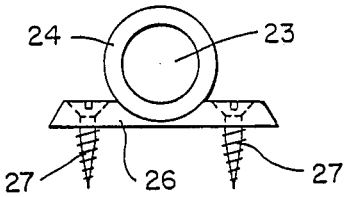
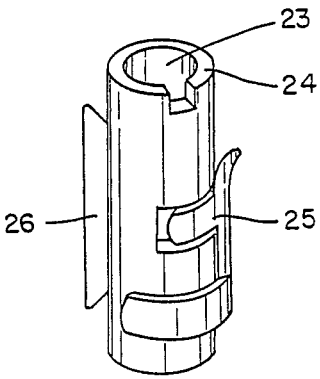
FIG. 5
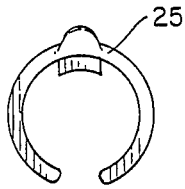
FIG. 7

QUICK POINT REVERSIBLE SLING SWIVEL ASSEMBLY FOR A RIFLE OR THE LIKE FOR RIFLE AND SHOTGUNS

BACKGROUND OF THE INVENTION

This invention relates to rifle fittings or accessories and more particularly to a sling swivel, a pair of which is designed to be attached to the butt and fore-end of the stock of a rifle, shotgun or the like.

This sling swivel is a modification and improvement of the reversible quick-point rifle and shotgun sling swivel described in my Philippine Patent No. UM-5909 issued Oct. 21, 1985.

SUMMARY OF THE INVENTION

An object of this invention is to provide a sling swivel specifically designed for a rifle, shotgun or similar firearm.

Another object of this invention is to provide a sling swivel structured so that a pair of such swivels when secured, together with a sling, to a stock of a rifle, shotgun or similar firearm, allows the firearm when carried on the shoulder, to be handled very easily and moved quickly into various positions.

Still another object of this invention is to provide a sling swivel structured so that a pair of such swivels when secured, together with a sling, to the stock of a rifle, shotgun or similar firearm, allows the firearm to be fired instantly from the waist or hip and, more importantly, to be mounted at the shoulder and fired at eye level along the line of sight.

A further object of this invention is to provide a sling swivel structured so that a pair of such swivels when secured, together with a sling, to the stock of a rifle, shotgun or similar firearm, allows the firearm to be carried in ready position without tiring the arms of the bearer.

Other objects and advantages of this invention will become clear and apparent from the description below.

BRIEF DESCRIPTION OF THE DRAWINGS

FIG. 1*d* is a rear view of the swivel part of FIG. 1a;

FIG. 4 is a perspective view of the rotating part of a fore-end swivel embodying this invention;

FIG. 5 is a perspective view of a fore-end receptacle for the rotating part of FIG. 4;

FIG. 6 is a top view of the fore-end receptacle of FIG. 5; and

FIG. 7 is a top view of the spring lock on the receptacle of FIG. 5.

BEST MODE FOR CARRYING OUT THE INVENTION

Figure 1A:
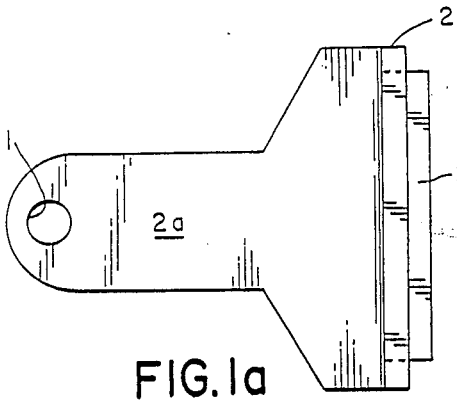
FIG. 1*a* is a top view of the rotating part of a butt swivel embodying this invention.
Figure 1D:
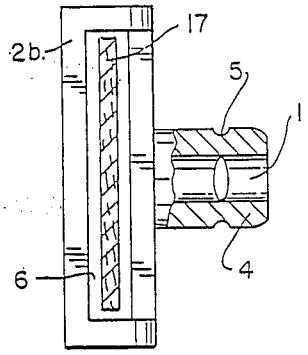
Figure 1B:
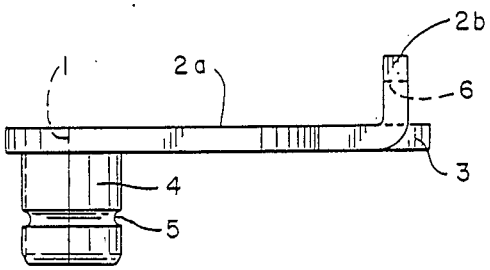
FIG. 1*b* is a side view of the swivel part of FIG. 1*a;*
Figure 1C:
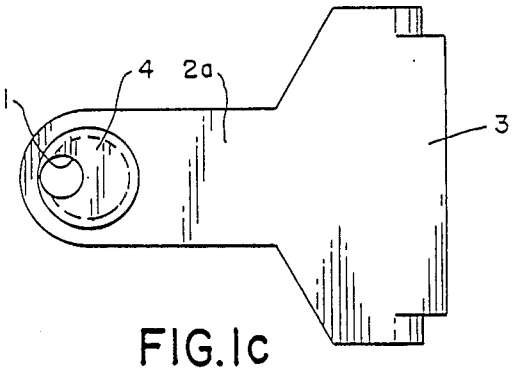
FIG. 1*c* is a bottom view of the swivel part of FIG. 1*a;*
Figure 2B:
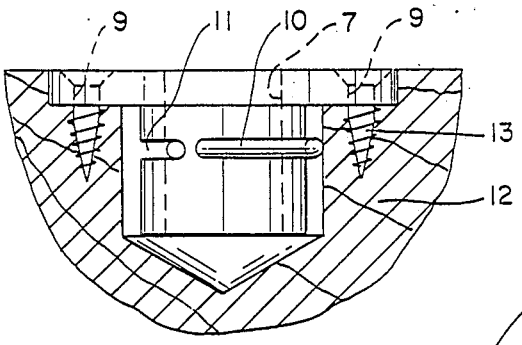
FIG. 2*b* is a side view of the receptacle of FIG. 2*a;*
Figure 3B:
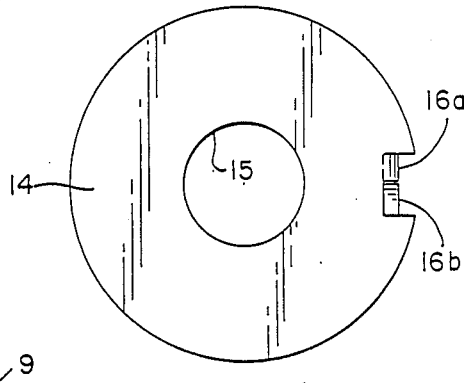
FIG. 3*b* is a top view of the limiter of FIG. 3*a;*
Figure 2A:
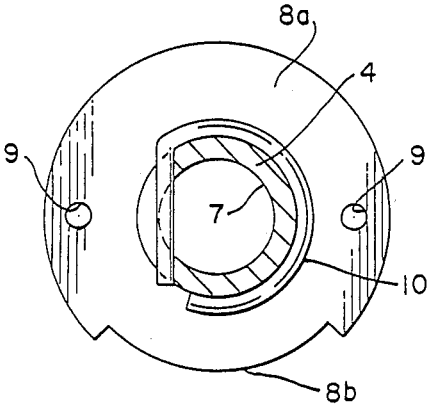
FIG. 2*a* is a bottom view of the receptacle part of the swivel that is attached to the side of the butt or forearm of a firearm.
Figure 2C:
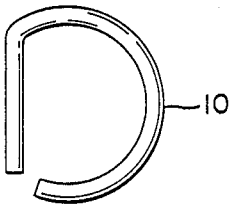
FIG. 2*c* is a bottom view of the spring clip in the receptacle of FIG. 2*a;*

Referring initially to FIGS. 1*a* to 3*b* of the drawing, the receptacle shown in FIG. 2 has a tubular opening 7 with an anchor plate 8*a* which is attached flush with the side of the rifle butt or forearm in an opening thereon by means of screws 13, through holes 9.

The rotating swivel part shown in FIG. 1 is attached to the receptacle of FIG. 2 by inserting the male plunger 4 into the female receptacle hole 7. The male plunger 4 is held securely within the female receptacle hole 7 by a spring 10 that is imbedded in the receptacle canal 11. The spring 10 homes unto the male plunger channel 5. In this position the rotating part of FIG. 1 is free to rotate 360 degrees along an axis perpendicular to the length of the rifle.

Figure 3A:
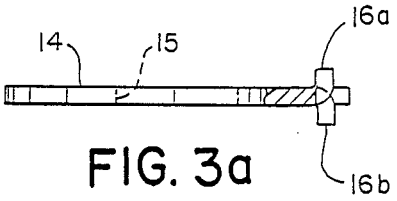
FIG. 3*a* is a side view of the limiter that can be attached between the rotating part and receptacle in order to limit the lateral rotation of the rotating part to around 360° more or less.

A limiter shown in FIG. 3 is placed flat between the rotating part of FIG. 1 and the receptacle of FIG. 2 with the male plunger 4 of the swivel passing through the hole 15 of the limiter. Two portions 16*a* and 16*b* of the outside periphery are bent at opposite sides of the limiter plate 14. The lower bent portion 16*b* is placed within the indented portion 8*b* of the receptacle of FIG. 2 and is free to rotate within the length of the indention 8*b*. The upper bent portion 16*a* blocks the edge 2*a* of the rotating part in order to limit the rotation of the rotating part to a little more than 360 degrees.

A sling 17 is inserted through the rectangular slot 6 of the outer end 2*b* of the rotating part. The tongue 3 of the rotating part prevents the sling 17 from scraping on the rifle.

The fore-end swivel assembly shown in FIGS. 4 to 7 is designed to be fitted at the fore-end of the rifle by screws 27 or by welding the wing 26 at the underside of the barrel. The swivel assembly of FIGS. 4 to 7 is attached in a position perpendicular to the side of the fore-end or under the barrel so that the slot 18 in the rotating part 19 rotates about an axis perpendicular to the length of the rifle and at the side of the barrel or fore-end.

The fore-end rotating part 19 which is elongated to balance the rifle above its longitudinal center of gravity is inserted plunger 22 first into the receptacle hole 23 until the spring lock 25 rests in the channel 20*b*. In this position the rotating part 19 is free to rotate 360 degrees until the channel block 21 hits the spring lock 25 and is allowed to rotate another 20 degrees more or less. The fore-end rotating part 19 can also be pushed into the slot 24 so that the spring lock 25 locks at the hole 20*a* of the part 19 in order for it to act as a monopod. The fore-end rotating part 19 is withdrawn by lfitng the spring lock 25 if one wishes to store it or to transfer the swivel to the other side of the rifle for a left handed shooter or to another rifle.

The butt swivel of FIGS. 1*a* to 3*b* can be detached by inserting a push button, a rifle bullet or the plunger 22 of the fore-end rotating part 19 into the hole 1. The bullet or plunger 22 moves aside the spring clip 10 out of the plunger channel 5 and the rotating part in FIG. 1 can be pulled out easily.

I claim:

1. A swivel assembly for connecting a sling to a long firearm comprising:

(a) A receptacle for mounting on the butt or foreend of the firearm, said receptacle having a tubular portion and a passage extending through the tubular portion to define first and second receptacle openings on opposite sides of said firearm (b) spring means extending into a center portion of said tubular portion, and (c) a rotating part having a male member for insertion into either of the first or the second receptacle opening of said tubular portion and having a sling receiving portion that defines an opening, said male member having channel means for engagement with said spring means to lock said rotating part within the tubular portion of said receptacle yet allow rotation of said rotating part about an axis passing through said tubular portion of said receptacle.

2. A swivel assembly according to claim 1 including means for limiting the degree of rotation of said rotating part within said receptacle.

3. A swivel assembly according to claim 1 wherein said spring means is movable out of said channel means to enable withdrawal of said rotating part from said receptacle.

4. The swivel assembly of claim 1 wherein the male member and channel means are integrally joined to said sling receiving portion of said rotating part by a bent portion of the rotating part.

* * * * *